US007137524B2

(12) United States Patent
Nomula

(10) Patent No.: US 7,137,524 B2
(45) Date of Patent: Nov. 21, 2006

(54) EASY-OPENING CONTAINER AND PLASTIC CLOSURE THEREOF FOR HERMETIC SEALING

(75) Inventor: Srinivas Nomula, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 357 days.

(21) Appl. No.: 10/627,562

(22) Filed: Jul. 25, 2003

(65) Prior Publication Data

US 2005/0017005 A1 Jan. 27, 2005

(51) Int. Cl.
*B65D 17/34* (2006.01)
*B65D 51/18* (2006.01)

(52) U.S. Cl. ..... 220/269; 220/254.1

(58) Field of Classification Search ..... 220/269, 220/270, 272, 273, 254.1, 276; 229/5.5, 229/5.8

See application file for complete search history.

(56) References Cited

U.S. PATENT DOCUMENTS

| | | | | |
|---|---|---|---|---|
| 3,459,315 | A | | 8/1969 | Labarre |
| 3,462,035 | A | | 8/1969 | Grussen |
| 3,608,771 | A | | 9/1971 | Monroe et al. |
| 3,612,340 | A | | 10/1971 | Heffran |
| 3,750,820 | A | | 8/1973 | Labarre |
| 4,320,861 | A | | 3/1982 | Rieke et al. |
| 4,402,451 | A | * | 9/1983 | Woerz et al. ..... 229/5.5 |
| 4,442,949 | A | | 4/1984 | Dwinell et al. |
| 4,533,063 | A | * | 8/1985 | Buchner et al. ..... 220/270 |
| 4,687,116 | A | * | 8/1987 | Dutt et al. ..... 220/270 |
| 4,702,387 | A | * | 10/1987 | Wombold ..... 220/270 |
| 4,840,289 | A | * | 6/1989 | Fait et al. ..... 220/270 |
| 4,890,759 | A | | 1/1990 | Scanga et al. |
| 4,892,227 | A | | 1/1990 | MacLaughlin |
| 5,042,226 | A | | 8/1991 | Osip et al. |
| 5,103,973 | A | * | 4/1992 | Sato ..... 220/270 |
| 5,713,481 | A | | 2/1998 | Jordan |
| 5,725,120 | A | | 3/1998 | Ramsey et al. |
| 5,799,813 | A | | 9/1998 | Letica |
| 5,806,710 | A | * | 9/1998 | Shiffer et al. ..... 220/785 |
| 6,450,357 | B1 | | 9/2002 | Krautkramer et al. |

* cited by examiner

*Primary Examiner*—Robin A. Hylton
(74) *Attorney, Agent, or Firm*—Alston & Bird LLP

(57) ABSTRACT

A plastic, easy-opening, retortable container for hermetic sealing is provided, and a closure for such a container. The closure includes a plastic membrane having inner and outer portions defined by a groove therebetween. The groove defines a fail portion that can be torn to open the container. A grip portion is connected to the inner portion so that a user can grasp the grip portion and pull the inner portion from the container. The fail portion is strong enough to resist failure during retort but allows the user to easily remove the inner portion to thereby open the container.

10 Claims, 2 Drawing Sheets

EASY-OPENING CONTAINER AND PLASTIC CLOSURE THEREOF FOR HERMETIC SEALING

BACKGROUND OF THE INVENTION

1) Field of the Invention

This invention relates to a plastic, easy-opening closure for hermetic sealing of an open end of a retortable container and an easy-opening container that is hermetically sealed by such a closure.

2) Description of Related Art

A variety of closures are known for the hermetic sealing of a container, such as conventional tin-plated steel cans that are widely used for containing food products. Retortable containers are those that can withstand a pasteurization or retort process comprising heat and pressure for preserving the food contents of the container. During retort, the container can be subjected to temperatures above 212° F. and up to 250° F. under pressures of 15 to 30 psi.

Easy-opening containers are those that can be opened without undue effort and without the use of a special tool such as a rotary can opener. In order for an easy-opening container to be retortable, the closure must be sufficiently strong to resist stresses that develop as a result of the retort heat and pressure but easily overcome during opening. One conventional easy-opening, retortable container includes a closure that is stronger in shear than tension. The closure is strong enough to withstand the shear force that develops during retort, while a relatively small tensile force is required to open the container. For example, U.S. Pat. No. 5,752,614, titled "Easy-Opening Closure for Hermetic Sealing a Retortable Container," to Nelson describes an easy-opening closure that includes a metal end ring that can be seamed to an open end of a retortable container and defines a central opening that is covered by a membrane patch. The membrane patch is bonded to the end ring such that the bond is unaffected during retort processing but has a predetermined tensile force strength that is preferably less than 5 psi to allow peeling of the membrane patch from the end ring. Thus, the container can be retorted and subsequently easily opened.

Other easy open containers are formed partially or wholly of plastic. For example, a lid that includes a metallic foil can be adhered to a plastic container, which can be used for retort. The adhesive used to bond the foil to the container is strong enough to withstand retort but can be easily overcome when a consumer peels the foil from the container. Attempts have also been made to manufacture retortable containers exclusively of plastic. For example, a plastic membrane can be heat sealed to a plastic container. Alternatively, the plastic membrane can be heat sealed to a plastic end ring that is similar to the metal end ring described by Nelson, and the plastic end ring can be fusion bonded to the container by spin welding. A pull ring or tab can also be provided on the plastic membrane so that a user can grasp the membrane to it from the container, thereby breaking the bond between the plastic membrane and the container or plastic end ring. Such bonds can be difficult to form by heat sealing due to the poor thermal conductivity of the plastic. Further, if the strength of the bond is not controlled precisely, the bond may be insufficiently strong to resist the stresses that are applied during retort or too strong for a user to overcome in order to open the container.

Thus, there exists a need for a plastic, easy-opening closure for hermetically sealing an open end of a retortable container and an easy-opening container that is hermetically sealed by such a closure. The closure should be strong enough to withstand the stresses induced during retort, but easily removed by a user.

BRIEF SUMMARY OF THE INVENTION

The present invention provides a plastic, easy-opening, retortable container for hermetic sealing and a closure for such a container.

According to one embodiment, the container has a bottom and side and defines an interior space and an opening thereto. The plastic membrane is joined to the base portion to cover the opening. An annular groove is disposed on a first side of the membrane and defines inner and outer coplanar portions thereof. A grip portion, such as a pull ring, is integrally connected to a second side of the membrane at the inner portion. The annular groove defines an annular fail portion between the inner and outer portions of the plastic membrane such that the inner portion can be removed from the outer portion by urging the grip portion away from the outer portion, thereby tearing the annular fail portion and opening the container.

The base portion can also be formed of plastic, and both the membrane and base portion can be formed of a high barrier material that prevents transmission of moisture and oxygen. For example, the membrane can be formed of polyolefin and can include oxygen scavengers disposed therein. The membrane can define a circumferential ridge extending from the first side for engaging the base portion of the container, for example, by a friction weld joint.

The grip portion can be connected to the inner portion of the plastic membrane by a primary connection portion and at least one secondary connection portion. The primary connection portions are weaker than the primary connection portion and configured to break when the grip portion is urged from the inner portion. Thus, the grip portion can be rotated, hinged by the primary connection portion, and then further pulled to open the container. Further, the fail portion can have a strength of about 14 pounds or less.

Thus, the present invention provides a plastic closure that can be used to hermetically seal a container. The closure and the container are retortable, and a fail portion on the membrane of the closure allows the container to be easily opened by a user.

BRIEF DESCRIPTION OF THE SEVERAL VIEWS OF THE DRAWINGS

Figure 1:
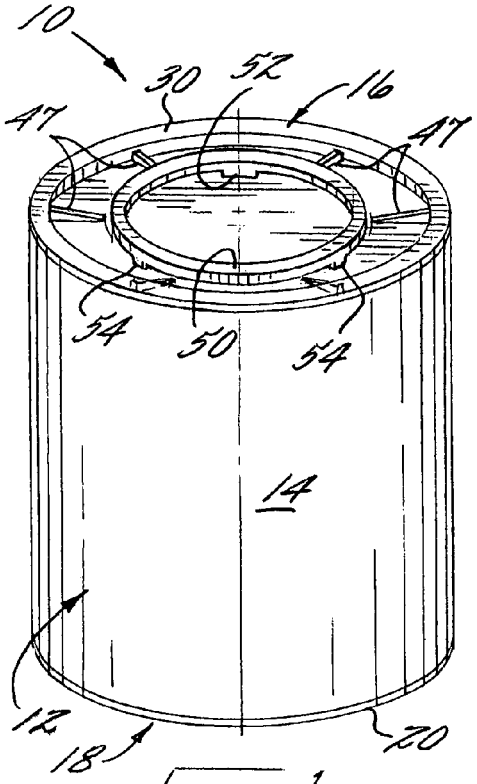
Figure 3:
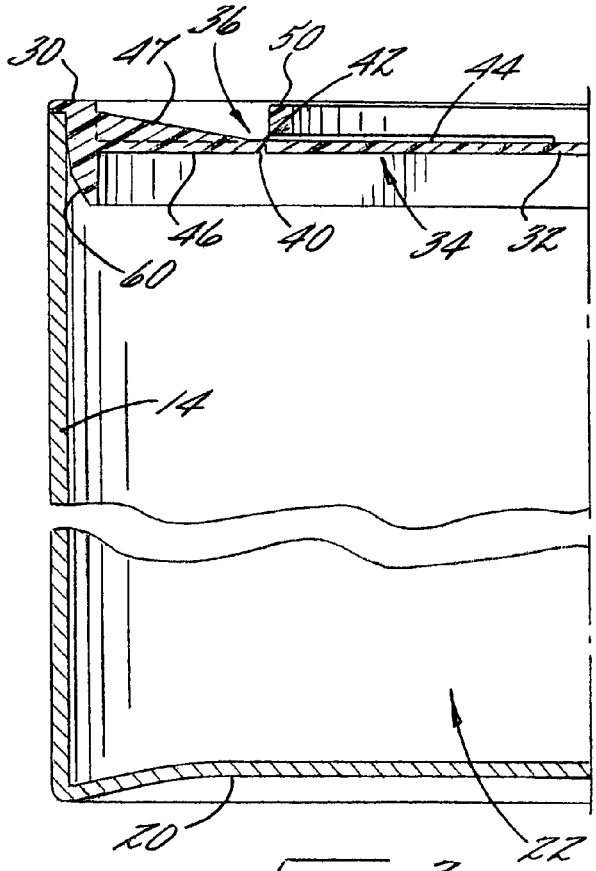
Figure 2:
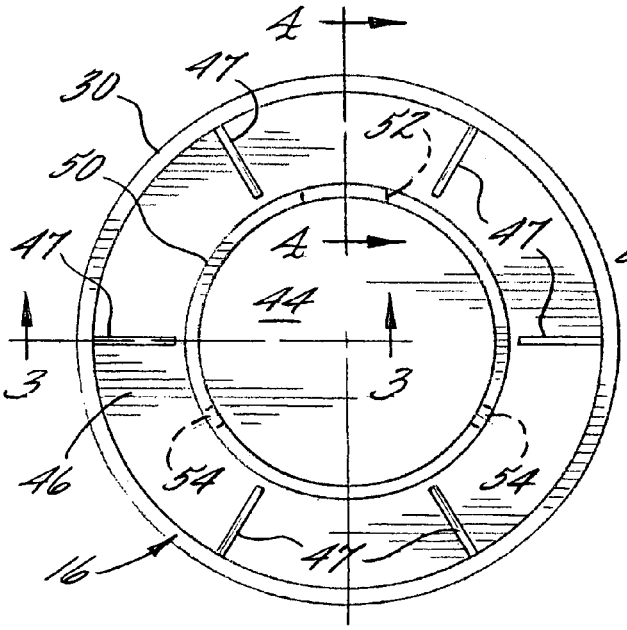
Figure 4:
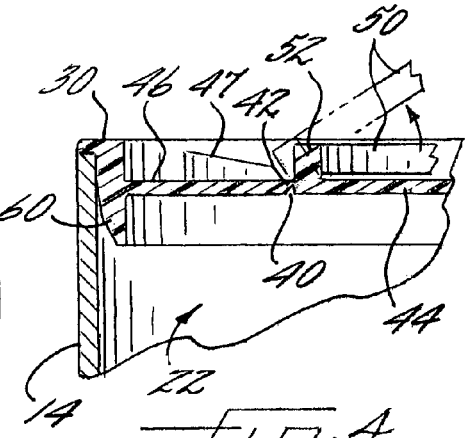
Figure 5A:
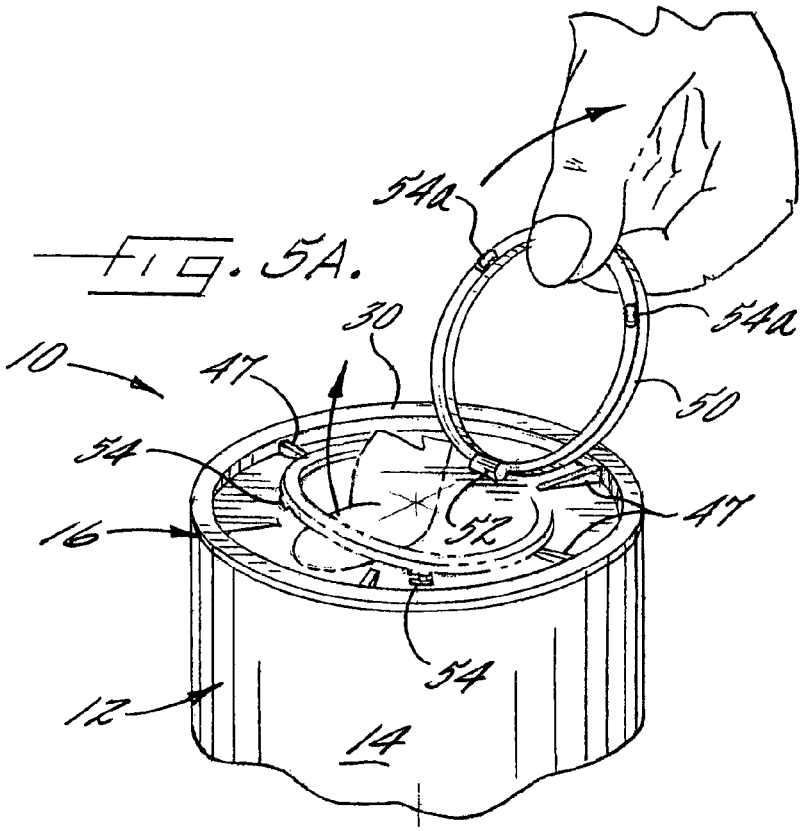
Figure 5B:
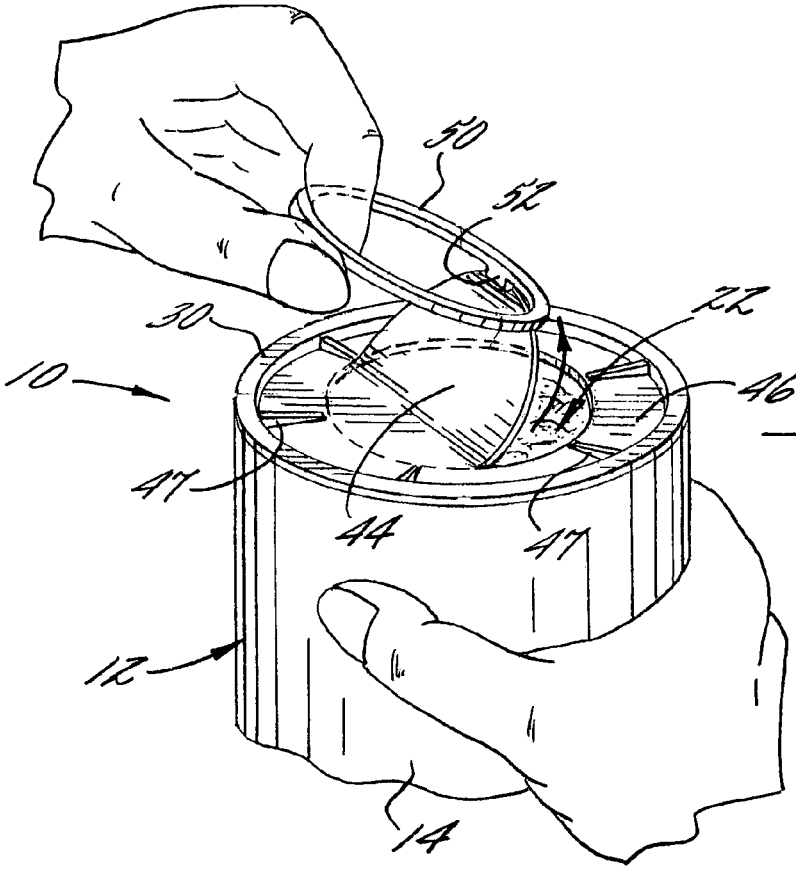

Having thus described the invention in general terms, reference will now be made to the accompanying drawings, which are not necessarily drawn to scale, and wherein:

FIG. 1 is a perspective view of an easy-opening, retortable container according to one embodiment of the present invention;

FIG. 2 is a plan view illustrating the container of FIG. 1;

FIG. 3 is a partial sectional view in elevation of the container of FIG. 1, as seen along line 3—3 of FIG. 2;

FIG. 4 is a partial sectional view in elevation of the container, as seen along line 4—4 of FIG. 2;

FIG. 5A is a perspective view of the container of FIG. 1, illustrating the operation of the pull ring, with the pull ring shown in both rotated and unrotated positions; and FIG. 5B is a partial perspective view of the container of FIG. 1, illustrating the removal of the closure.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Referring now to FIGS. 1 and 2, there is shown an easy-opening container 10 according to one embodiment of the present invention. The container 10 has a base portion 12, which defines an openable first end 16 that is closed by a closure 30. The base portion 12 can be formed of a variety of materials, such as metals, including steel, aluminum, and tin, as well as plastic, cardboard, and laminates of multiple materials. In the illustrated embodiment, the base portion 12 includes a continuous cylindrical side 14 that extends longitudinally from the openable first end 16 to a second end 18, which is closed by a bottom 20. Preferably, at least the openable first end 16 of the base portion 12 has a circular cross section so that the closure 30 can be friction welded thereto. The side 14 can also comprise alternative configurations, for example, multiple rectangular panels configured at right angles so that part or all of the base portion 12 has a square cross section instead of circular as shown. The bottom 20 can be formed separately from the side 14 and joined thereto, for example, by crimping, welding, gluing, and the like. Alternatively, the side 14 and the bottom 20 can be formed as a unitary member, for example, by injection molding or blow molding the side 14 and bottom 20 of plastic. Additionally, the side 14 can have a tapered shape, such as a conical shape, that includes the bottom 20.

The openable first end 16 is closed by the closure 30 such that the base portion 12 and the closure 30 define an interior space 22 therein, which can be hermetically sealed. As shown in FIG. 1, the closure 30 can be connected to the side 14 of the base portion 12. Alternatively, however, the base portion 12 can also include an end ring that extends radially inward from the side 12 to define an opening that is smaller than the diameter of the side 14 at the first end 16. Such end rings are known in the art, as are various methods of connecting the end ring to the base portion, such as by forming a double seam around the circumference of the openable end 16.

As shown in FIG. 3, the closure 30 includes a membrane 32 that covers the openable end 16. The membrane has first and second opposing sides 34, 36, the first side being directed toward the interior space 22 of the container 10. A groove 40 or score extends annularly on the membrane 32 and defines a fail portion 42. For example, as shown in FIG. 3, the groove 40 is disposed on the first side 34 of the membrane 32, and the groove 40 therefore defines the fail portion 42 between the groove 40 and the second side 36 of the membrane 32. In other embodiments, the groove 40 can be disposed on the second side 36 of the membrane 32 so that the fail portion 42 is defined between the groove 40 and the first side 34. The groove 40 can define a circular shape or other shapes including a rectangle, ellipse, and the like.

The groove 40 defines an inner membrane portion 44 radially within the groove 40 and an outer membrane 46 portion radially outside the groove 40. The inner and outer membrane portions 44, 46 are preferably coplanar. By coplanar, it is meant that at least the adjoining edges of the inner and outer membrane portions 44, 46 are coplanar, i.e., the outermost portion of the inner membrane portion 44 is coplanar with the innermost portion of the outer membrane portion 46. Thus, the entire inner and outer membrane portions 44, 46 can lie in a single plane, as shown in FIGS. 1–3, or one or both of the membrane portions 44, 46 can define nonplanar contours. Flanges 47 can be provided on one or both of the membrane portions 44, 46 to stiffen or otherwise provide support to the membrane portions 44, 46.

The closure 30 also includes a grip portion such as a pull ring 50 that is disposed on the second side 36 of the membrane 32, i.e., opposite the groove 40, as shown in FIG. 3. Alternatively, the grip portion can be a tab or other feature that can be grasped or otherwise manipulated by a user to open the container 10. The pull ring 50 is attached to the inner membrane portion 44 by a primary connection 52 so that the user can peel the inner membrane portion 44 from the container 10 by pulling on the ring 50. Further, one or more secondary connections 54 can be provided between the pull ring 50 and either of the membrane portions 44, 46 or another part of the container 10. The secondary connections 54 are preferably weaker than the primary connection 52 so that the user can first break the secondary connections 54, then pull the ring 50 away from the container 10, thereby pulling the inner membrane portion 44 via the primary connection 52.

For example, the user can grasp the pull ring 50 at a location near or between the secondary connections 54 and urge the pull ring 50 away from the container 10 to thereby break the secondary connections 54 and rotate the pull ring 50 about the primary connection 52, as shown in FIGS. 4 and 5A. Thus, the pull ring 50 rotates or hinges about the primary connection 52 so that further urging on the pull ring 50 begins to tear the fail portion 42 at a location near the primary connection 52, as shown in FIG. 5B. Portions 54*a* of the broken secondary connections 54 can remain connected to the pull ring 50. The user can then continue to tear the fail portion 42 circumferentially in both directions from the primary connection portion 52 until the container 10 is sufficiently opened and/or the inner membrane portion 44 is completely removed from the closure 30. The outer membrane portion 46 remains in place when the inner membrane portion 44 is removed so the outer membrane portion 46 defines an opening 48 to the interior space 22 of the container 10.

Preferably, the closure 30 provides a hermetic seal to the container 10 such that the container 10 can be used for storing food items and other items requiring a hermetic seal or a reduced or enhanced storage pressure. The closure 30, including the fail portion 42, is sufficiently strong to withstand the retort process, in which the sealed container 10 is subjected to relatively high temperatures and corresponding internal pressure; however, a person can easily open the container 10 by pulling on the pull ring 50 and tearing the fail portion 42. For example, the closure 30, including the fail portion 42, can have a shear force strength of at least about 20 psi, and the fail portion 42 can have a tensile force strength that is less than about 14 pounds. Thus, the fail portion 42 can withstand the stresses applied during retort, but tears when put in tension by the user.

The closure 30 is preferably formed as an integral member, for example, by injection or blow molding the closure 30 of plastic. The closure 30 can be formed with a mold that defines the inner and outer membrane portions 44, 46, the groove 40, the pull ring 50, and the connections 52, 54. If the closure 30 is molded, the groove 40 can be formed during the same molding process. Alternatively, the groove 40 can be formed by cutting, grinding, or otherwise removing material from the membrane 40. Various types of plastic can be used, and a high barrier material can be used where desired to prevent the transmission of moisture, oxygen, or other fluids, such as where the container 10 is used in food packaging. For example, the closure 30 can be formed of a polyolefin such as polypropylene. Further, chemical compounds that absorb oxygen, referred to generally as oxygen scavengers, can be disposed in the polyolefin to prevent the transmission of oxygen through the lid. For example, a moisture-activated, iron oxide-based oxygen scavenger can be used.

The closure 30 can also define a feature for connecting the closure 30 to the side 14 of the container 10. For example, as shown in FIG. 3, a circular ridge 60 can be provided at an outer periphery of the outer membrane portion 46, the ridge 60 corresponding in diameter to the side 14 so that the ridge 60 can be connected thereto. The outer diameter of the ridge 60 can correspond to an inner diameter of the side 14 so that the ridge 60 can be inserted into the container 10. Alternatively, the inner diameter of the ridge 60 can correspond to the outer diameter of the side 14 so that the ridge 60 receives the side 14 therein.

The closure 30 and the base portion 12 can be joined by gluing or adhering, press fitting, welding, or other methods. For example, the closure 30 can be spin welded to the side 14 by rotating the closure 30 relative to the base portion 12 and pressing the outer membrane portion 46 against the side 14 such that frictional heat is generated therebetween. A portion of the closure 30 and/or the base portion 12 are thereby plasticized, and as the plasticized region mixes and cools, a friction bond is formed, joining the closure 30 to the base portion 12.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An easy-opening, retortable container comprising:

a base portion having a bottom and side and defining an interior space and an opening thereto;

a single-layer plastic membrane of sufficient size to cover said opening, said membrane defining first and second sides and having coplanar inner and outer portions, said outer portion being friction welded to said base portion, said inner and outer portions being defined by an annular groove disposed in one of the first and second sides of said membrane; and a grip portion integral to said plastic membrane, said grip portion being disposed on said second side of said plastic membrane and connected to said inner portion, wherein said grip portion is a circumferentially continuous annular pull ring extending generally in a plane substantially parallel to said plastic membrane; and wherein said annular groove defines an annular fail portion between said inner and outer portions of said plastic membrane such that said inner portion is structured to be removed from said outer portion by urging said grip portion away from said outer portion, thereby tearing said annular fail portion and opening the container, and wherein said grip portion defines a circle having a diameter which substantially corresponds to a diameter of said annular groove, each of the annular fail portion defined by the annular groove and the diameter defined by the grip portion being centered about a common axis that is coaxial with a central axis of the container.

2. An easy-opening, retortable container according to claim 1 wherein said base portion is formed of plastic.

3. An easy-opening, retortable container according to claim 1 wherein said grip portion is connected to said inner portion of said plastic membrane by a primary connection portion and at least one secondary connection portion, said at least one secondary connection portion being circumferentially spaced from said primary connection portion and weaker than said primary connection portion such that said at least one secondary connection portion is configured to break when said grip portion is urged from said inner portion such that said grip portion is hinged by the primary connection portion.

4. An easy-opening, retortable container according to claim 1 wherein said fail portion has a strength of about 14 pounds or less.

5. An easy-opening, retortable container according to claim 1 wherein said membrane and said base portion are each formed of a high barrier plastic material to prevent transmission of moisture and oxygen therethrough.

6. An easy-opening, retortable container according to claim 1 wherein said membrane is formed of polyolefin.

7. An easy-opening, retortable container according to claim 1 wherein said membrane includes oxygen scavengers disposed in a polyolefin.

8. An easy-opening, retortable container according to claim 1 wherein said outer portion of said membrane defines a circumferential ridge extending from said first side of said membrane, said ridge structured to engage said base portion of the container.

9. An easy-opening, retortable container according to claim 8 wherein said circumferential ridge extends in a continuous circular path from said first side of said outer portion of said membrane, said ridge defining a tapered profile and corresponding in diameter to said side of said base portion, and said ridge being friction welded to said side of said base portion.

10. An easy-opening, retortable container according to claim 1 wherein said grip portion is formed during molding of said plastic membrane such that said grip portion is integral to said plastic membrane.

* * * * *